US008064640B2

(12) United States Patent
Wirtz et al.

(10) Patent No.: US 8,064,640 B2
(45) Date of Patent: Nov. 22, 2011

(54) METHOD AND APPARATUS FOR GENERATING A PRECISION FIRES IMAGE USING A HANDHELD DEVICE FOR IMAGE BASED COORDINATE DETERMINATION

(75) Inventors: Michael M. Wirtz, Ridgecrest, CA (US); Patrick Simpson, Ridgecrest, CA (US); Frank Modlinski, Ridgecrest, CA (US); David Schaeffer, Ridgecrest, CA (US); An Vinh, Ridgecrest, CA (US); Felipe Jauregui, Ridgecrest, CA (US); Brett Edwards, Ridgecrest, CA (US); Diane Tilley, Inyokern, CA (US); Wendy Chang, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 1037 days.

(21) Appl. No.: 11/942,362

(22) Filed: Nov. 19, 2007

(65) Prior Publication Data

US 2008/0181454 A1 Jul. 31, 2008

Related U.S. Application Data

(63) Continuation-in-part of application No. 10/816,578, filed on Mar. 25, 2004, now Pat. No. 7,440,610.

(51) Int. Cl.
*G06K 9/00* (2006.01)

(52) U.S. Cl. ..... 382/103; 382/100; 382/154

(58) Field of Classification Search ..... 382/100, 382/103, 154

See application file for complete search history.

(56) References Cited

U.S. PATENT DOCUMENTS

| | | | | |
|---|---|---|---|---|
| 4,949,089 | A * | 8/1990 | Ruszkowski, Jr. | 342/52 |
| 6,651,004 | B1 * | 11/2003 | Perruzzi et al. | 701/302 |
| 6,823,621 | B2 * | 11/2004 | Gotfried | 42/70.06 |
| 7,440,610 | B1 * | 10/2008 | Wirtz et al. | 382/154 |
| 7,690,145 | B2 * | 4/2010 | Peters et al. | 42/111 |

* cited by examiner

*Primary Examiner* — Stephen Koziol

(74) *Attorney, Agent, or Firm* — Brian Drazich; Robert Lerma; Chris Blackburn

(57) ABSTRACT

A software application to generate a Precision Fires Image (PFI) which provides a precision targeting coordinate to guide an air launched weapon using a forward deployed hand held hardware device executing the PFI software application. Suitable hardware devices to execute the PFI software application include the Windows CE handheld and the Army Pocket Forward Entry Device (PFED). Precision targeting coordinates derived from the PFI software application are compatible with most military target planning and weapon delivery systems.

17 Claims, 6 Drawing Sheets

METHOD AND APPARATUS FOR GENERATING A PRECISION FIRES IMAGE USING A HANDHELD DEVICE FOR IMAGE BASED COORDINATE DETERMINATION

CROSS-REFERENCE TO RELATED APPLICATIONS

This continuation-in-part application claims priority from U.S. patent application Ser. No. 10/816,578, now U.S. Pat. No. 7,440,610 filed on Mar. 25, 2004 titled "APPARATUS AND METHOD FOR IMAGE BASED COORDINATE DETERMINATION".

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefore.

BACKGROUND OF THE INVENTION

1. Field of the Invention

A software application and a hardware device to generate a Precision Fires Image (PFI) which provides a precision targeting coordinate to guide a variety of coordinate seeking weapon. Coordinate seeking weapons are a class of weapons which includes, air launched weapons, ship launched weapons and ground artillery, all of which may benefit from a forward deployed hand held hardware device executing the PFI software application. Suitable hardware devices to execute the PFI software application include the Windows CE handheld and the Army Pocket Forward Entry Device (PFED). Precision targeting coordinates derived from the PFI software application are compatible with most military target planning and weapon delivery systems.

2. Description of the Prior Art

Military conflicts and targets of interest are increasingly situated in densely populated urban areas. The goal of the military is to prevent civilian casualties and minimize any collateral damage that may occur as a result of an air strike attacking a valid military target situated in a densely populated urban area. Modern enemies willingly exploit any non-combatant casualties and any collateral damage, creating the need for new precision targeting tools to accurately deploy guided munitions. Additionally, military commitments throughout the world strain budgetary and material resources, while stressing a risk-averse and casualty-averse approach to military operations, mandating the most efficient use of forward deployed forces and minimal exposure of those deployed military forces.

Generally, employing precision guided munitions relies upon the availability of very accurate geodetic coordinates. Historically, generating these accurate geodetic coordinates have required an extensive array of computer resources such as: a large amount of computer memory for data storage, high throughput computer processing hardware, fast memory devices, complex computer software applications, large computer display screens and a network of connected communications equipment.

It is known to correlate selected prepared imagery with imagery available from an airborne platform. Methods of performing multi-spectral image correlation are discussed in a patent issued to this inventor, U.S. Pat. No. 6,507,660 and titled "Method for Enhancing Air-to-Ground Target Detection, Acquisition and Terminal Guidance and an Image Correlation System".

It is also known to correlate a digitally created image to an image provided in real-time resulting in a composite image containing the edges of objects within a scene. This is accomplished by digital edge extraction processing and a subsequent digital data compression based on comparing only the spatial differences among the pixels. This process is discussed in a patent issued to this inventor, U.S. Pat. No. 6,259,803 and titled, "Simplified Image Correlation Method Using Off-The-Shelf Signal Processors to Extract Edge Information Using Only Spatial Data".

It is further known to obtain a true geodetic coordinate for a target using a Reference Point Method in conjunction with an optical stereo imagery database. Obtaining a true geodetic coordinate for a target using a Reference Point Method is discussed in a patent issued to this inventor, U.S. Pat. No. 6,988,049 and titled, "Apparatus and Method for Providing True Geodetic Coordinates".

Currently available, is a first-generation software application known as the Precision Strike Suite Special Operating Forces that is completely described in the patent application from which this continuation-in-part application claims priority. This first-generation software application is tied to bulky laptop computers and numerous cable connectors; in use by forward observers to obtain precision targeting coordinates. The laptop computers and cable connectors severely limit forward observer mobility when compared to the mobility available with hand held devices and wireless communications. Furthermore, the ability to generate the precision targeting coordinate from a single click on a hand held device greatly reduces the operator training and reduces workload while maintaining the overall quality of the precision targeting coordinate.

With wireless communications, the operator of the PFI enabled handheld device remains sheltered while an observer with a laser range finder is free to move wherever is necessary, be it across a rooftop or across terrain, in order to laser a target and transmit the target location to the operator of the PFI enabled device. The limitations associated with each one of the inventions patented by this inventor is that these inventions, in combination, are unsuitable for execution on a forward deployed hand held device having memory limited storage capacity, having a small user display and a minimal user interface streamlined for ease of use. It is an object of the PFI software application to preprocess numerous stereo images for synchronization, download and use on a forward deployed a hand held device for generating a true geodetic coordinate suitable for use as a target reference point for guided munitions.

SUMMARY OF THE INVENTION

One embodiment of the invention is a computer program product incorporating an algorithm that is used to generate a Precision Fires Image (PFI) from which a user may designate a point that is converted to a precision targeting coordinate that is passed to guided munitions. The PFI provides a user with the ability to precisely designate items of interest within their field of view and area of influence by simply positioning a single marker, a cursor, on the desired item, a target. Precision targeting coordinates reduce non-combatant casualties, increase combatant casualties, reduce collateral damage, use munitions effectively and lower delivery costs while providing immediate detailed information regarding local terrain.

Another embodiment of the invention is a method allowing a user to designate a point that is subsequently converted to a precision targeting coordinate and passing the precision coordinate to guided munitions. The method relies upon a PFI for designating the targeting coordinate and a user interface for accepting user input.

A further embodiment of the invention is an apparatus for providing a precision targeting coordinate to guided munitions. The apparatus must support execution of a software program in a forward deployed battle space. The apparatus must contain all of the computer processing, computer memory, computer interfaces and PFI software programs to designate a point as a precision target coordinate.

Each of the aforementioned embodiments generates a PFI using a National Imagery Transmission Format (NITF) file that consists of a single overhead satellite image, also known as a surveillance image, and a geo-referenced, three-dimensional template derived from a stereo referenced image. Several types of stereo referenced imagery are available and they include, the Digital Point Positioning Database (DPPDB), the Controlled Image Base (CIB), Digital Terrain Elevation Data (DTED) and vector maps such as VMAP or its commercial equivalents. Regardless of the type of stereo reference imagery used, the user is then forced to select one of two processing paths.

One path uses the stereo referenced image and a surveillance image provided from either a surveillance satellite or aircraft and invokes portions of the Digital Precision Strike Suite—Scene Matching (DPSS-SM) processing. DPSS-SM is the preferred path when the stereo referenced imagery and a surveillance image are both available. This is due to the timeliness and relevancy of the information contained within the tactical image since a current satellite image or other current tactical image may present road movable targets.

A second path is selected in the absence of a surveillance image. The PFI software application is used to generate a PFI directly from the stereo referenced imagery when only the stereo referenced imagery is available. Regardless of the image source used to generate the PFI, the PFI enabled hand held is then used to accept a point designation from the user that is converted to a precision targeting coordinate and passed to the guided munitions.

In embodiments of the present invention the PFI application is embodied on computer readable medium. A computed-readable medium is any article of manufacture that contains data that can be read by a computer. Common forms of computer-readable media include, for example, floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EPROM, any other memory chip or cartridge, or any other medium from which a computer can read.

All of the embodiments described above use an image processing software algorithm executing on a laptop or desktop computer to preprocess stereo images. The image processing software preprocesses numerous stereo images through a series of transformations and correlations prior to downloading the preprocessed images to the forward deployed hand held device. This preprocessing step is the step that reduces, by an order of magnitude, the memory required to convert a user designated point to a weapons grade coordinate.

DETAILED DESCRIPTION OF THE PREFERRED EMBODIMENT

It is to be understood that the foregoing general description and the following detailed description are exemplary and explanatory only and are not to be viewed as being restrictive of the present invention, as claimed. Further advantages of this invention will be apparent after a review of this detailed description of the disclosed embodiments in conjunction with the drawings.

Embodiments of the present invention include an apparatus, a method and a computer program product for preprocessing and displaying a single composite image from which a user selects a point using a moveable cursor, for performing a conversion of the user selected point to a single geodetic coordinate, calculating error terms for the conversion from the selected point to the single geodetic coordinate and outputting a result which combines the conversion and the error terms. The term single geodetic coordinate and weapons grade coordinate are used interchangeably throughout this specification and claims.

Figure 1:
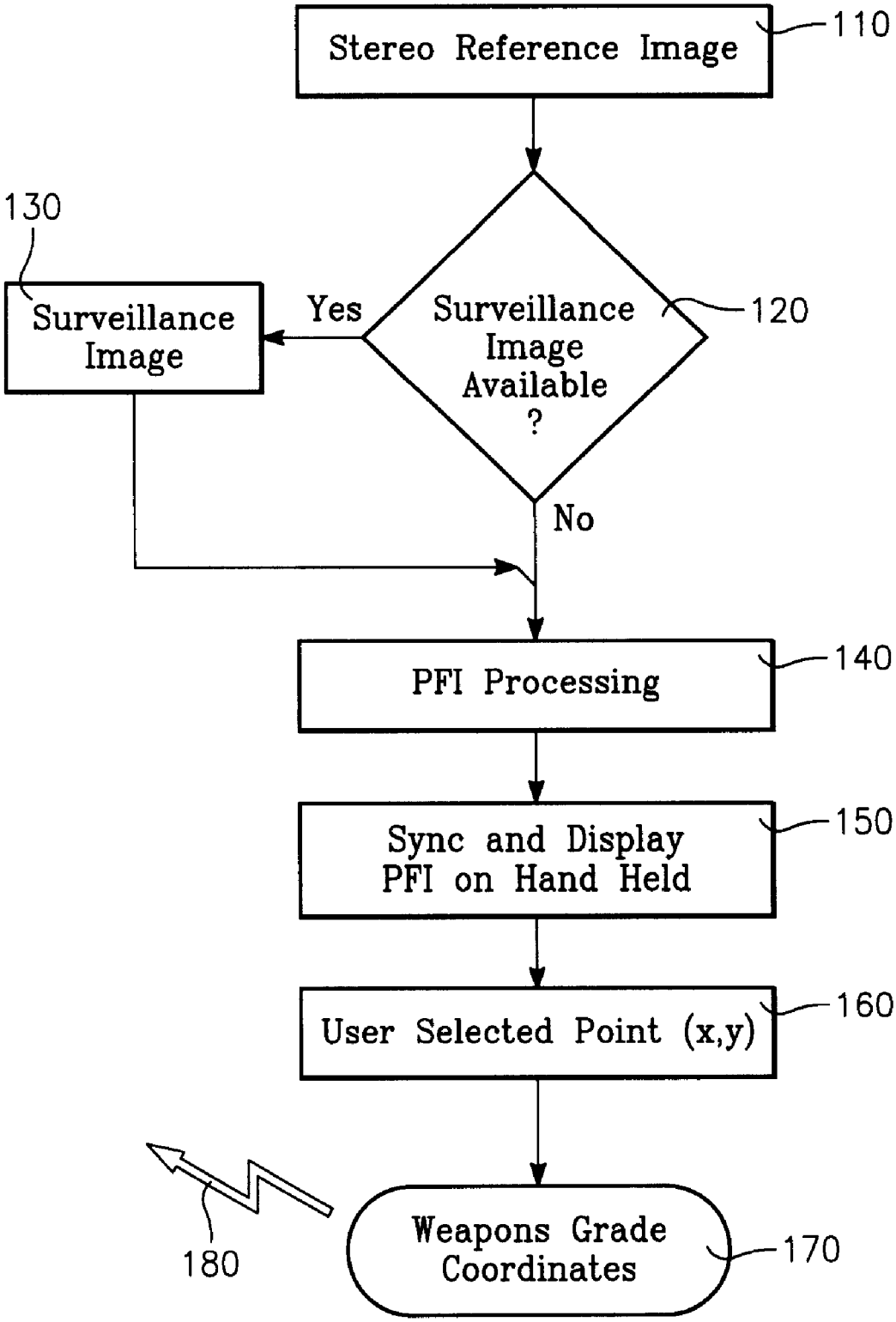
FIG. 1 is a high level functional block diagram showing the major steps required to generate weapons grade coordinates on a hand held device.

The Precision Fires Image (PFI) implementation consists of an NITF file containing a single image and a geo-referenced three-dimensional template derived from stereo reference imagery. As illustrated in FIG. 1, a PFI can be produced by following one of two PFI processing paths, one path incorporates a stereo reference image and an available surveillance image, the other path uses only the stereo reference image. A surveillance image is an image derived from a surveillance aircraft, a satellite, or any other overhead intelligence gathering platform. The preferred embodiment uses a Digital Point Positioning Database (DPPDB) as a source of stereo reference imagery.

The PFI processing path incorporating an available surveillance image takes advantage of the Digital Precision Strike Suite with Scene Matching (DPSS-SM) described in U.S. Pat. No. 6,507,660. DPSS-SM is a National Geospatial-Intelligence Agency (NGA) validated system based on an algorithm that semi-automatically registers satellite imagery to stereo reference images. Non-air-breather images, such as, NTM or commercial satellite, or air-breather images, such as, the Shared Reconnaissance Pod (SHARP), are considered surveillance imagery in this context. The PFI is adapted to use the DPPDB reference imagery directly, and is intended for those cases where the surveillance imagery for the operational area is not directly available. The DPSS-SM is the image processing software run at the preprocessing stage.

The PFI coordinate conversion software is intended to be used on hand held systems that lack the computing resources available on a desktop or laptop computer that are necessary to run either the Precision Strike Suite-Special Operations Forces (PSS-SOF) or the DPSS-SM directly. Both the PSS-SOF and the DPSS-SM require extensive amounts of computer memory and high throughput processors due to the large amount of stereo referenced image data processed.

FIG. 1 is a high level functional block diagram depicting the major functions required to produce weapons grade coordinates 170 from the DPPDB stereo reference imagery. The DPPDB is a stereo reference image 110 has parametric support data, compressed reference graphics and high resolution optical imagery stereo pair sets each covering a 60×60 nautical mile area. A surveillance image availability check 120 is made to determine if a surveillance image that corresponds with the DPPDD stereo reference image 110 is available from either a satellite or an aircraft. If the surveillance image availability check 120 is negative, Precision Fires Image (PFI) preprocessing 140 proceeds using only the images available in the DPPDB. If the surveillance image availability check 120 is positive, then step to process the surveillance image 130 is invoked prior to executing PFI preprocessing 140. Upon the completion of PFI preprocessing 140 a PFI image is available for synchronization and display on a hand held device 150. From the displayed PFI image 150 a user may select a point 160 for conversion to a weapons grade coordinate 170. Arrow 180 represents wireless communication.

Figure 2:
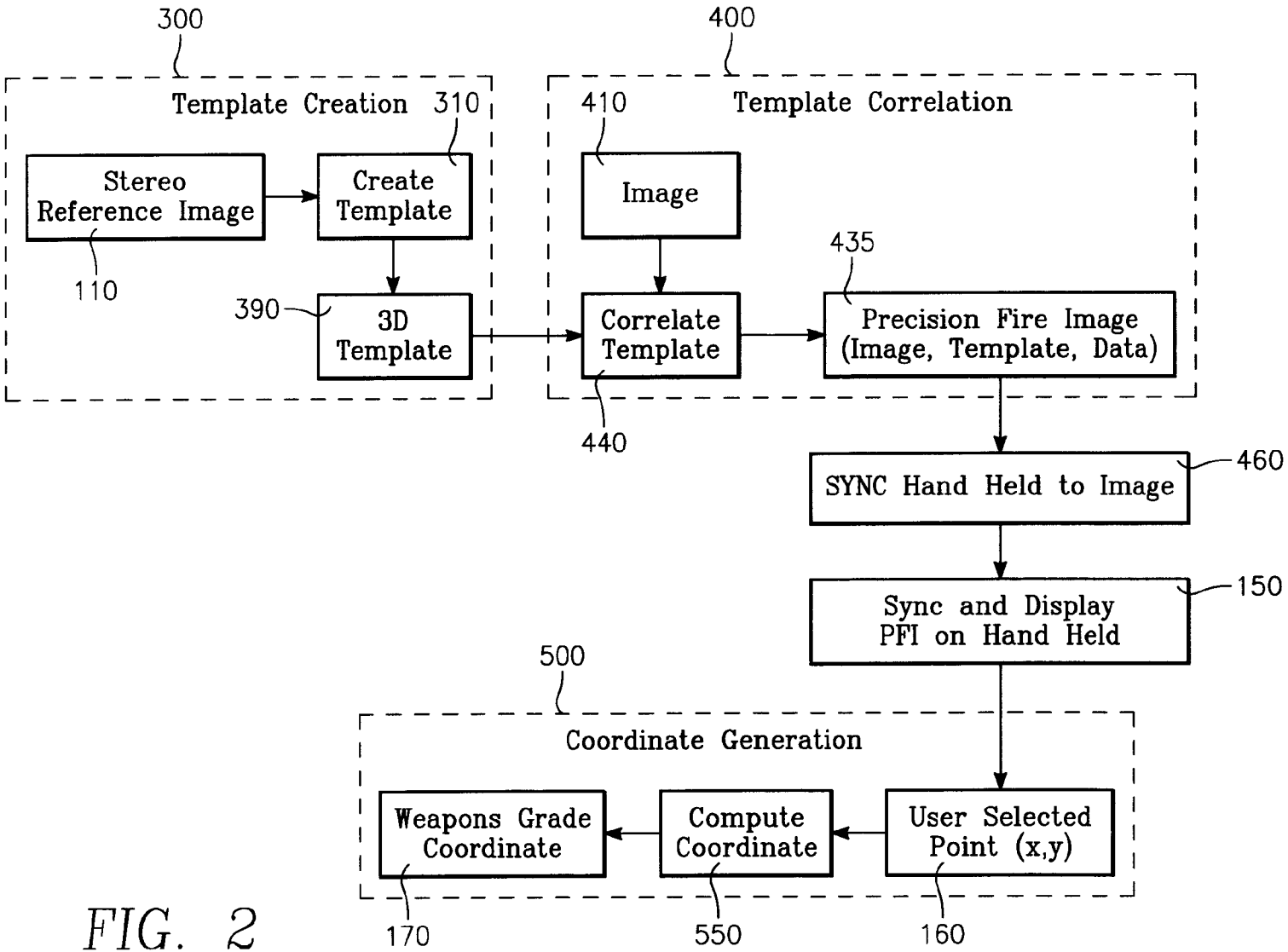
FIG. 2 is a low level functional block diagram showing the software flow for the various steps to generate a weapons grade coordinate on a hand held device.

FIG. 2 is a functional block diagram showing additional detail necessary to generate the weapons grade coordinates 170. There are three functional blocks that will be discussed in order of operation. The first functional block is the Template Creation block 300 in which the DPPDB stereo reference image 110 is an input to a module that will create a template 310 whose output is a 3-Dimensional (3D) template 390. The 3D template 390 serves as an input to a Template Correlation functional block 400.

The second functional block is the Template Correlation functional block 400 containing several modules. The first module is a correlate template module 440 using a surveillance image if it is available or DPPDB stereo reference image 410. In the event that the surveillance image 410 is not available the correlate template module 440 invokes a left right stereo image from the DPPDB stereo reference image 110. The output of the Template Correlation functional block 400 is a PFI image 435. The PFI image contains information for a correlated image template, icons in the control field (FIG. 6 item 610) and support data, all of which will be described in detail below. The PFI image 435 is then synchronized to a hand held device in module 460 in order to display the PFI image 435 on the screen of the hand held device.

The third functional block is the Coordinate Generation block 500 which allows the user to designate a selected point 160 on the screen of the hand held device from which a coordinate can be computed in module 550. The coordinate computation (module 550) leads to a weapons grade coordinate 170 suitable for targeting guided munitions.

Figure 3:
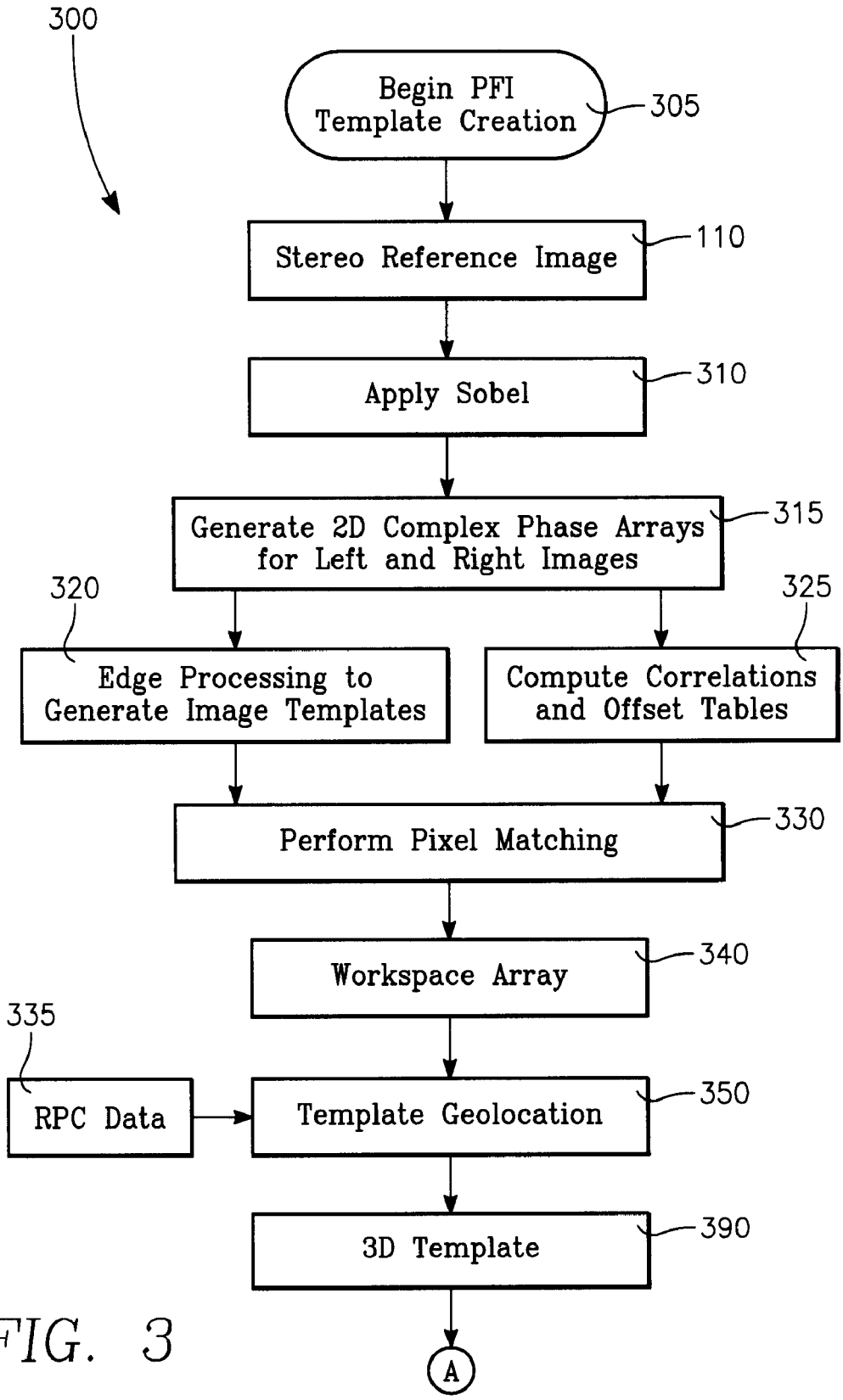
FIG. 3 is a software flowchart describing the Template Creation modules.

We now turn to a detailed description of the operation of each of the three functional blocks discussed above, beginning on FIG. 3 with PFI Template Creation block 305. The DPPDB stereo reference image 110 is loaded into the hand held device along with the PFI software program. The PFI software program contains a Sobel algorithm 310 that is the preferred method of effecting the gradient operation used to detect the contrast boundaries that are part of the DPPDB stereo reference image 110 which serves as the reference image, as described in the '660 patent. As described in the '660 patent, the output of the Sobel algorithm 310 is a pair of two dimensional complex phase arrays 315, one for the left hand portion of the stereo image and one for the right hand portion of the stereo image. The pair of two dimensional (2D) complex phase arrays 315 are then subjected to edge processing (module 320) where the contrast edge boundaries are thinned and represented by a series of points stored in a corresponding pair of image templates, one for the right image and one for the left image. The pair of two dimensional complex phase arrays 315 are then simultaneously subjected to a Fourier series computation to compute a point to point correlation between the left image points and the right image points, storing the results of the correlation in a pair of corresponding correlation offset tables 325. The results of the edge processing module 320, the information stored in the corresponding correlation offset tables, and the offset data 325 for the correlation computations 325 are stored in computer memory for later use. The results of the edge processing module 320 and the information stored in the pair of corresponding correlation offset tables 325 are made available to a pixel matching processing module 330.

The pixel matching processing module 330 is the critical and novel step that reduces the memory size requirement for the coordinate conversion by an order of magnitude, from gigabytes to megabytes. The pixel matching process (module 330) eliminates the necessity to store each and every pixel point in both the left and right phase array images 315. The correlation data and the offset tables (module 325) retain the information to necessary to reduce the overall size of the original image and yet ensure that the reference image data is usable for further correlations and transformations. This pixel matching process (module 330) extracts and retains only the correlated stereo image data. The reduced size of the correlated stereo image data is what facilitates the use of a hand held device, which is an object of the invention. The results of the pixel matching processing module 330 are then stored in a workspace array 340.

The pixel matching processing module 330 performs the critical and novel step that reduces the memory size requirement for the coordinate conversion by an order of magnitude, from gigabytes to megabytes. The pixel matching process (module 330) eliminates the necessity to store each and every pixel point in both the left and right phase array images 315. The correlation data and the offset tables (module 325) retain the information that results in a reduction of the overall size of the original stereo reference image and yet ensure that the stereo reference image data 110 is usable for further correlations and transformations. The pixel matching process (module 330) extracts and retains only the correlated stereo image data. The reduced size of the correlated stereo image data is what facilitates the use of a hand held device, which is an object of the invention. The results of the pixel matching processing module 330 are then stored in a workspace array 340.

A set of rational polynomial coefficients (RPC) are stored in the RPC module 335 and are used as coefficients to translate the DPPDB spatially referenced image to a ground based image format. The RPC data stored in module 335 and the information in the workspace array 340, serve as inputs to a template geolocation processing step 350. The template geolocation processing module 350 performs a processing step that converts each point in the left and right stereo image data from a spatial point to a point having a ground space coordinate based on latitude, longitude and altitude. The conversion of the spatial points to points having a ground space coordinate are stored as three dimensional (3D) ground space templates in module 390, one template for the right image and one template for the left image. Description of the Template Creation functional block as shown in FIG. 2 item 300 is complete. We now turn to a detailed description of the operation of the second functional block as shown in FIG. 2 functional block 400.

Figure 4:
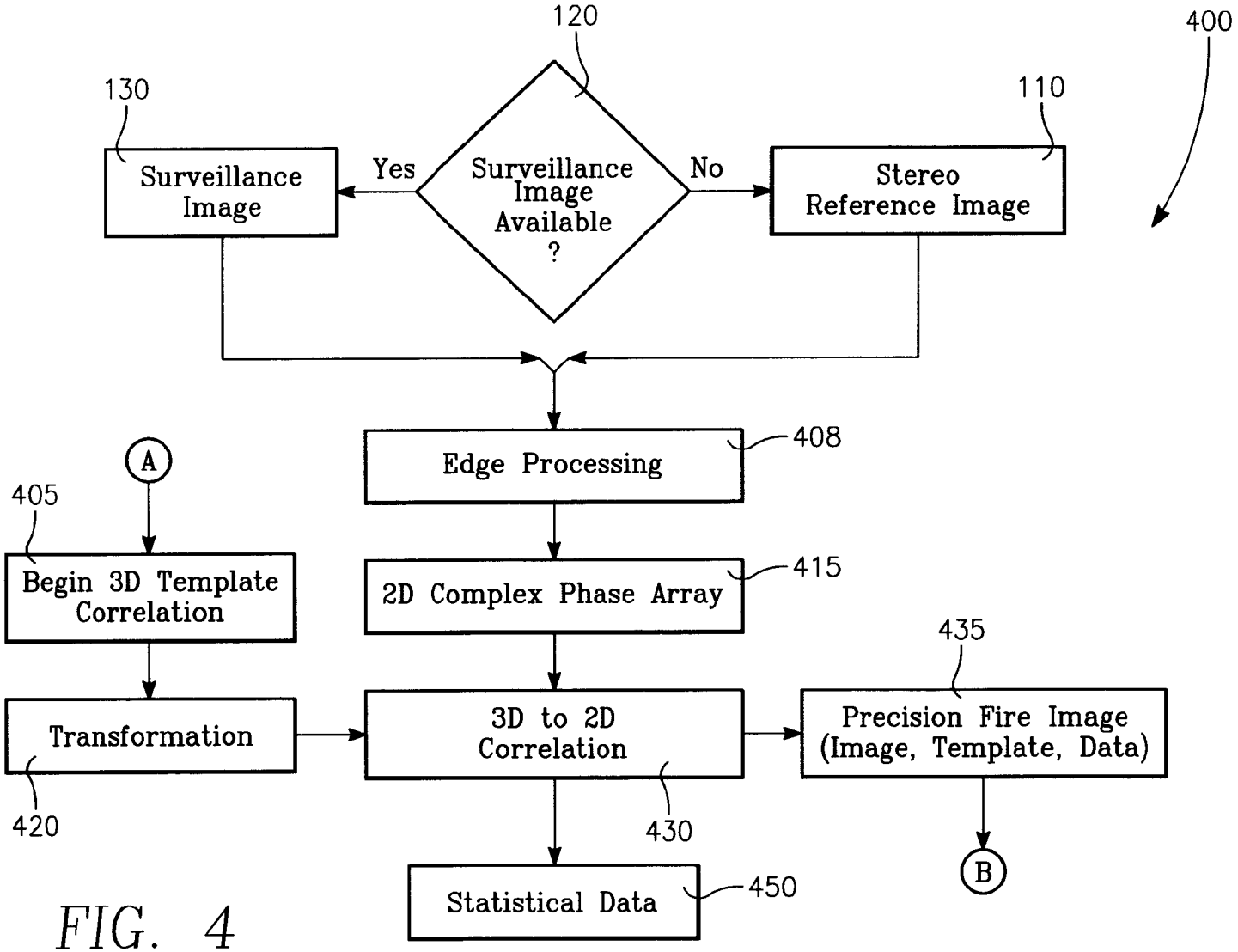
FIG. 4 is a software flowchart describing the Template Correlation modules.

Referring to FIG. 4, the PFI 3D ground space template correlation begins with module 405, accepting the 3D ground space template (FIG. 3 item 390) for transformation in module 420. The transformation performed in module 420 is from a 3D ground space template to a rotated 3D ground space template. The transformation performed in module 420 is a perspective 3D transformation rotated about the x, y, and z axis to produce a rotated 3D ground space template. Transforming the 3D ground space template to a rotated 3D ground space template in module 420 is necessary because a subsequent 3D to 2D correlation (module 430) will be performed in which the frames of reference for the templates to be correlated must match. The correlation performed in module 430 uses either the surveillance image 130 or the left right stereo image from the DPPDB stereo reference image 110, as determined in image availability check 120. A set of statistical values containing raw error terms and the correlation sigma values are stored as statistical data in module 450. The result of the correlation in module 430 is a PFI image containing a 3D template, a correlated 2D template and data, all of which are ready for image synchronization to the hand held device as shown in FIG. 2 item 460. The preprocessing performed by PFI image processing software is complete leaving only the hand held synchronization step 450.

Figure 5:
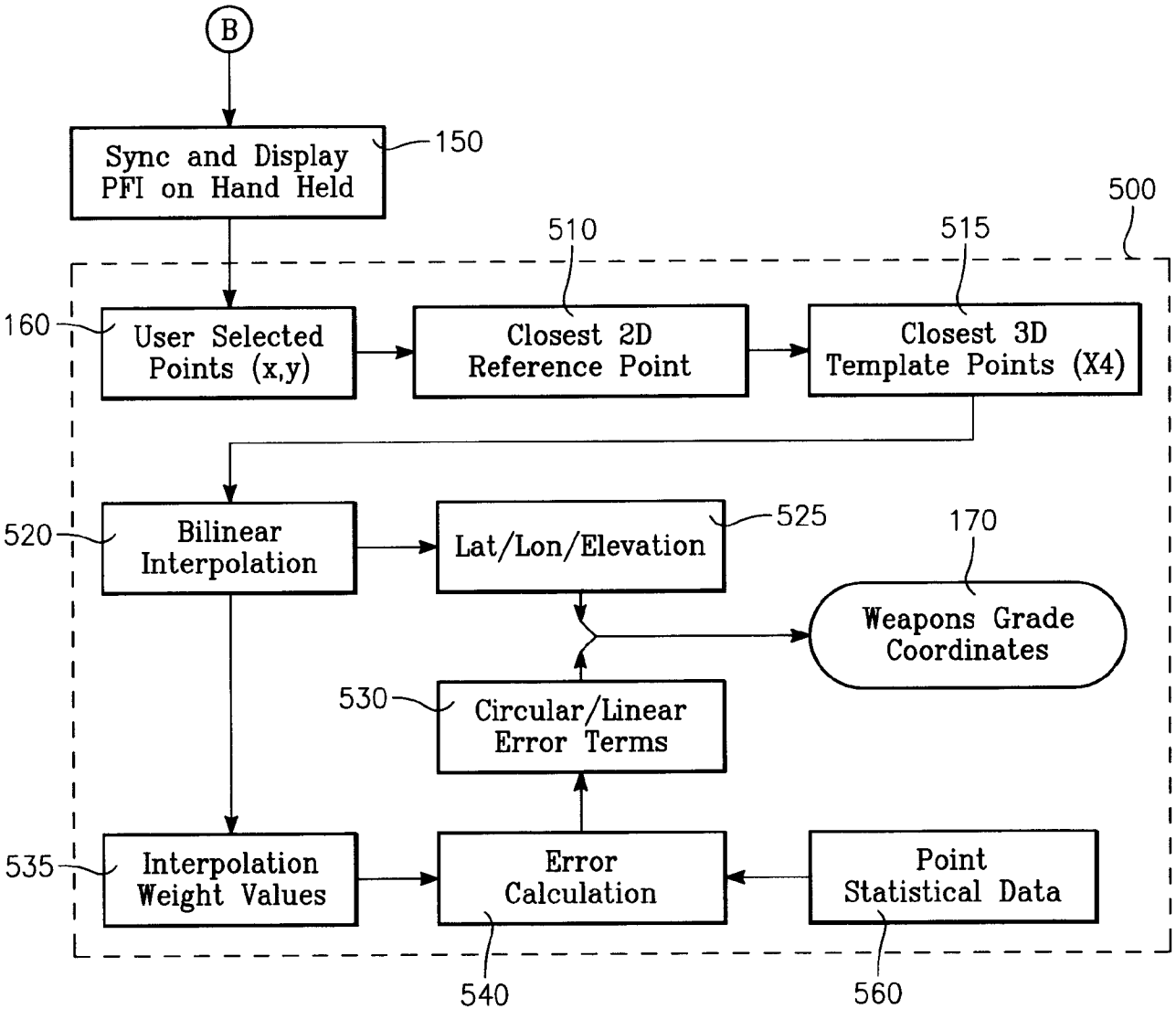
FIG. 5 is a software flowchart describing the Coordinate Generation modules.

We now turn to a detailed description of the operation of the third functional block 500, as shown in FIG. 2. Referring to FIG. 5, once synchronization of the PFI image to the hand held device is complete the PFI image 620 will be displayed on the hand held per module 150. The PFI image is composed of the 3D tactical template with the correlated 2D tactical template superimposed. The 3D tactical template is representative of the topography and structures 665 as viewed from above. The 2D tactical template is composed of points that have been determined to correlate between the 3D and 2D tactical templates. To the user, the PFI image 620 is perceived as a grayscale topographical image with points, which are colored dots 660, distributed over the grayscale topographical image. The color selected for drawing the dots are any color that ensures the dots 660 are easily perceived by the user. One color that is high in contrast and easily perceived by the user is the color yellow. Once the PFI image 620 is displayed the user is able to select a point 160 on the PFI image 620 for conversion to a weapons grade coordinate 170.

The processing to convert the user selected point to a weapons grade coordinate begins by first converting the user selected point to a coordinate represented by an x and y position as in module 160. This x and y position will be used as a reference point to determine the four closest points that lie in the 2D tactical template as in module 510. From the four closest points in the 2D tactical template only a single point is closest to the x and y position. The single point closest to the x and y position is used as a new reference point. A simple square root of the sum of the squares will yield the 2D tactical template point closest to the x and y position. This new 2D reference point will be used to locate the four closest points in the 3D tactical template as shown in module 515. A simple square root of the sum of the squares will yield the four 3D tactical template points closest to the 2D reference point. The four closest 3D points will serve as the basis for a bilinear interpolation calculation (module 520). The bilinear interpolation calculation (module 520), will result in a determination of points in the 3D tactical template which contain the best latitude, longitude and elevation data (module 525). As the bilinear interpolation calculation is performed in module 520 a corresponding set of interpolation weighting values are calculated in module 535. The set of interpolation weighting values in module 535 will be used as part of a point statistical error calculation (module 540).

The error calculation 540 uses the set of interpolation weight values calculated in module 535 and the point statistical data in module 560. Quantifying the statistical errors associated with the latitude, longitude and elevation point determined in module 540 allows the calculation of a circular error of probability (CE) and a linear area of probability (LE), per module 530. In combination, the longitude, latitude, elevation, CE and LE results in a weapons grade coordinate 170 referenced to the user selected point of module 160.

Figure 6C:
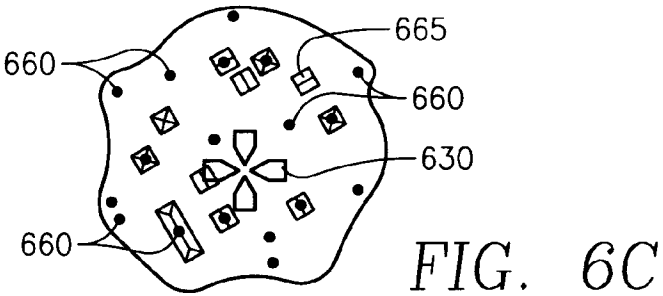
FIG. 6*c* is a section of the precision fires image specifically depicting the 3D grayscale topography with the correlated 2D points overlayed.
Figure 6B:
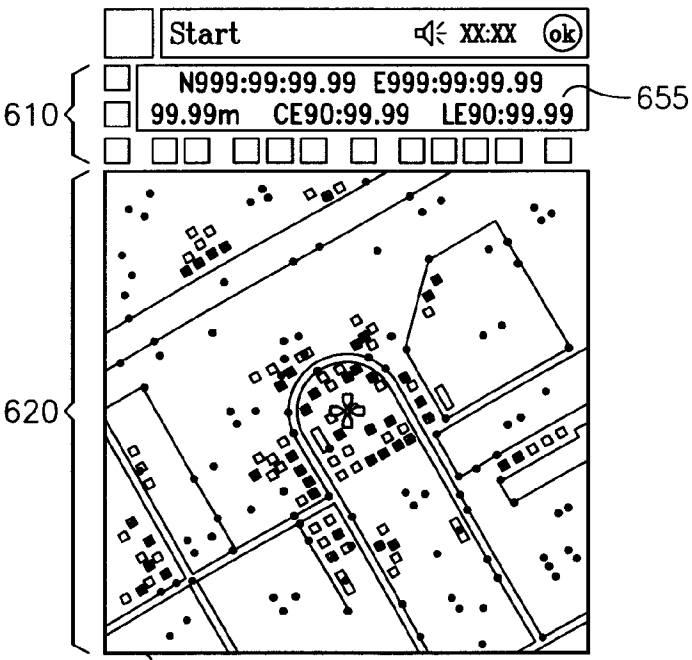
FIG. 6*b* is a depiction of representative display available on a hand held responding to a "Get Coordinate" command issued in FIG. 6*a*, specifically showing the latitude, longitude, elevation and error terms for the weapons grade coordinate.
Figure 6A:
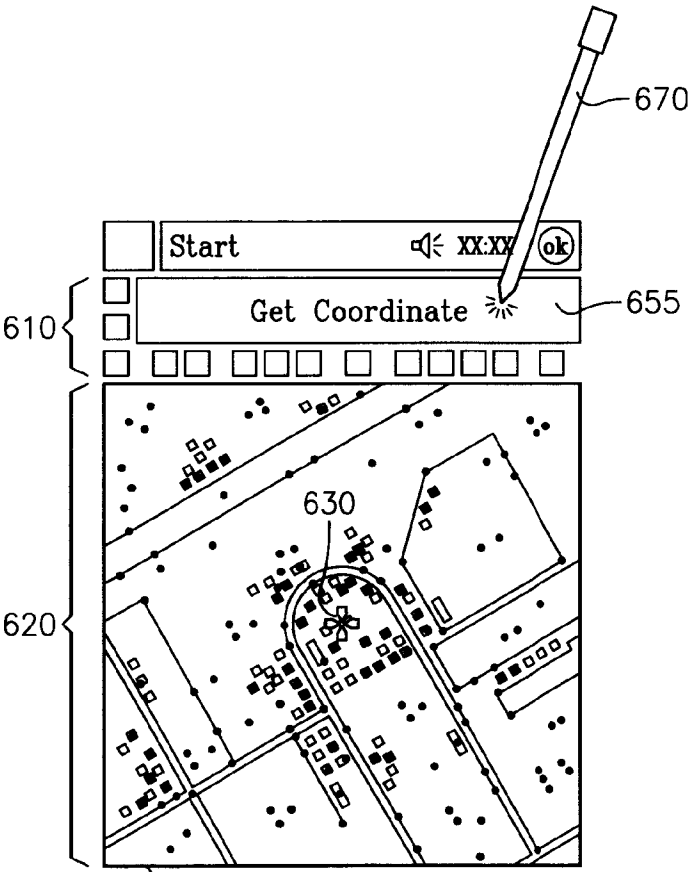
FIG. 6*a* is a depiction of a representative display available on a hand held executing the PFI software application, specifically showing the menus, control buttons, image scene, target point cursor and correlated 2D points.

Referring to FIG. 6*a* and FIG. 6*b*, shown are two representative depictions of the PFI displays on a hand held device. The left most display, item 600, is a typical screen segmented into two distinct fields, the first field 610 depicts numerous icons for manipulating the PFI template 620 and for performing file control operations and the second field, which is a PFI template 620. FIG. 6*c* is an exploded cutout depicting the structures 665, the 2D correlated points (dots) 660 and a cursor 630 used to mark the user designated point from module 160 in FIG. 5.

The icon and control field 610 contains icons that allow the user to manipulate the image displayed in the tactical template field 620. Manipulations include moving the tactical template field 620 from left to right, up or down and zooming in on a portion of the image. Other icons in the icon and control field 610 allow the user to choose any number of stored images, to save a particular image after manipulation and to exit PFI processing. The user may also transmit the weapons grade coordinate, FIG. 1 item 170, to a receiving device (not shown) upon user command. One means of transmitting the weapons grade coordinate is via a wireless communication 180. In one embodiment the wireless communication conforms to the Bluetooth protocol.

The tactical template field 620 is composed of the 3D tactical template topography with the 2D tactical template dots 660 superimposed. Near the center of the tactical template field 620 a cursor 630 denotes the position of a first click for designating the user selected point in step 160. A click is performed by pressing the point of a stylus 670 onto the screen of the handheld device, either item 600 or 605. Once the user has selected the target point using a first click a cursor 630 marks the point to be converted to a weapons grade coordinate. The user then places the stylus 670 onto the Get Coordinate field 655 and performs a second click. The second click commands the PFI software algorithm to convert the point designated by the first click, to a latitude, a longitude, an altitude, a CE and an LE and displays this information as shown in the right most display 605 in the coordinate field 665.

The PFI software application is written in a computer language compatible with a variety of Microsoft Windows based hand held devices. Those skilled in the art would recognize that PFI software application may be written in other computer languages and that the hand held device interfaces can be customized without departing from the embodiments described above and as claimed. Although the description above contains much specificity, this should not be construed as limiting the scope of the invention but as merely providing an illustration of several embodiments of the present invention. Thus the scope of this invention should be determined by the appended claims and their legal equivalents.

What is claimed is:

1. A method to generate a weapons grade coordinate from a user designated point using a hand held device wherein said hand held device has loaded thereon a plurality of precision fires image templates and a precision fires image software application, said method comprising:

executing an image processing software algorithm to generate said plurality of precision fires image templates and a control field;

synchronizing a result of said image processing software algorithm to said hand held device;

accepting a first click on a display screen wherein said first click selects said user designated point within a selected precision fires image template and denotes said user designated point with a cursor on said display screen;

accepting a second click within said control field wherein said second click commands execution of a conversion software algorithm to convert said user designated point to said weapons grade coordinate; and accepting a third click within said control field wherein said third click communicates a result of said conversion software algorithm using a wireless link.

2. The method of claim 1, said image processing software algorithm further comprising:

downloading a plurality of stereo reference images from a database;

selecting a single stereo reference image from said plurality of stereo reference images wherein said single stereo reference image includes a left half and a right half;

applying a Sobel algorithm to said left half of said single stereo reference image wherein a result of applying said Sobel algorithm is a left edge pixel template;

applying said Sobel algorithm to said right half of said single stereo reference image wherein a result of applying said Sobel algorithm is a right edge pixel template;

creating a two dimensional complex phase array for each half of said single stereo reference image;

executing an edge process upon said left edge pixel template and said right half edge pixel template wherein said edge process produces a single edge processed pixel template;

performing a correlation computation to compute a correlation between a pixel in said left half of said single stereo reference image and a pixel in said right half of said single stereo reference image wherein a result of said correlation computation is stored in a correlation table;

performing an offset value computation to compute an offset value corresponding to said correlation computation wherein said offset value represents a spatial difference in location between said pixel in said left half of said single stereo reference image and said pixel in said right half of said single stereo reference image;

performing a rational polynomial coefficient computation corresponding to said result of said correlation computation and storing a result of said rational polynomial coefficient computation as a coefficient data set;

performing a pixel matching comparison wherein said pixel matching comparison compares said single edge processed pixel template to said correlation table and stores a result of said pixel matching comparison in a workspace array;

producing a three dimensional geolocated template using said results of said pixel matching comparison as stored in said workspace array and using said coefficient data set to produce said three dimensional geolocated template;

transforming said three dimensional geolocated template wherein a result of a transformation of said three dimensional geolocated template is a rotated three dimensional geolocated template;

downloading a plurality of surveillance images;

selecting a single surveillance image from said plurality of surveillance images wherein said single surveillance image has a left half and a right half;

determining a presence of said single surveillance image;

generating a two dimensional complex phase array wherein said two dimensional complex phase array is derived from a result of said presence of said single surveillance image; and building a precision fires image template using a result of a three dimensional to two dimensional correlation wherein said three dimensional to two dimensional correlation uses as an input said rotated three dimensional geolocated template and said two dimensional complex phase array.

3. The method of claim 1, said conversion software algorithm further comprising:

determining a two dimensional reference point from within said selected precision fires image template wherein said two dimensional reference point is closest to said first click;

determining a set of four three dimensional points from within said selected precision fires image template wherein said set of four three dimensional points are determined to be closest in linear distance to said two dimensional reference point;

performing a bilinear interpolation of a result of said of four closest three dimensional points wherein a result of said bilinear interpolation is a single coordinate having a latitude, a longitude, an elevation, and a set of coordinate interpolation weighting values corresponding to said two dimensional reference point;

determining a plurality of error terms for said single coordinate wherein said plurality of error terms include a circular error of probability and a linear error of probability; and combining said single coordinate with said plurality of error terms wherein a combination resulting from said combining defines said weapons grade coordinate.

4. The method of claim 1, said selected precision fires image template is further comprising information from a three dimensional template and a two dimensional template wherein said two dimensional template contains information from a surveillance image.

5. The method of claim 1, said selected precision fires image template is further comprising information from a three dimensional template and a two dimensional template wherein said two dimensional template contains information from a Digital Precision Point Data Base.

6. The method of claim 1, said selected precision fires image template is further comprising a three dimensional grayscale topographical image having superimposed thereon, a plurality of two dimensional points appearing as dots.

7. A hand held apparatus for generating a single weapons grade coordinate corresponding to a user designated target position, comprising:

means for executing an image processing software algorithm to generate a plurality of precision fires images and to generate a control field;

synchronization means for synchronizing a result of said image processing software algorithm to said hand held apparatus;

display means for a selectively displaying of one of said plurality of precision fires images and to display said control field wherein said selective display of one of said plurality of precision fires images is a precision fires image template;

means for accepting a first click on said display means wherein said first click selects a point within one of said precision fires image selectively displayed and denotes said point with a cursor; and means for executing a conversion algorithm wherein said conversion algorithm producing said single weapons grade coordinate corresponding to said user designated target position, upon accepting a second click within said control field said conversion algorithm comprises:

means for determining a two dimensional reference point from within said precision fires image template wherein said two dimensional reference point is closest in linear distance to said first click;

means for accepting a set of four three dimensional points from within said precision fires image template wherein said set of four three dimensional points are closest in linear distance to said two dimensional reference point;

means for performing a bilinear interpolation of a result of said set of four three dimensional points wherein a result of said bilinear interpolation is a single coordinate having a latitude, a longitude, an elevation, and a set of coordinate interpolation weighting values corresponding to said two dimensional reference point;

means for determining a series of error terms corresponding to said single coordinate wherein said series of error terms include a circular error of probability and a linear error of probability;

means for combining said single coordinate with said series of error terms wherein a result of combining said single coordinate with said series of error terms is a weapons grade coordinate; and means for accepting a third click within said control field wherein said third click communicates a result of said conversion algorithm using a wireless link to transmit said weapons grade coordinate.

8. The hand held apparatus of claim 7, said image processing software algorithm is further comprising:

means to download a plurality of stereo reference images from a database;

means to select a single stereo reference image from said plurality of stereo reference images wherein said single stereo reference image has a left half and a right half;

means for applying a Sobel algorithm to said left half of said single stereo reference image wherein a result of applying said Sobel algorithm is a left edge pixel template;

means for applying said Sobel algorithm to said right half of said single stereo reference image wherein an output of applying said Sobel algorithm is a right edge pixel template;

means for creating a two dimensional left edge complex phase array wherein said means for creating uses as an input said left edge pixel template;

means for creating a two dimensional right edge complex phase array wherein said means for creating uses as an input said right edge pixel template;

means for executing an edge process upon said two dimensional left edge complex phase array and said two dimensional right edge complex phase array wherein said edge process produces a single edge processed pixel template;

means for performing a correlation computation to compute a correlation between a pixel in said two dimensional left edge complex phase array and a pixel in said two dimensional right edge complex phase array wherein a result of said correlation computation is stored in a correlation table;

means for performing an offset value computation to compute an offset value corresponding to said correlation computation wherein said offset value represents a spatial difference in location between said pixel in said two dimensional left edge complex phase array and said pixel in two dimensional right edge complex phase array;

means for performing a rational polynomial coefficient computation corresponding to said result of said correlation computation;

means for calculating a result of a standard deviation computation wherein said standard deviation computation is stored as a coefficient data set;

means for performing a pixel matching comparison wherein said pixel matching comparison compares said single edge processed pixel template to said correlation table and stores a result of said pixel matching comparison in a workspace array;

means to produce a three dimensional geolocated template using said results of said pixel matching comparison as stored in said workspace array and using said coefficient data set to produce said three dimensional geolocated template;

means to transform said three dimensional geolocated template wherein a result of a transformation of said three dimensional geolocated template is a rotated three dimensional geolocated template;

means to determine a presence of a surveillance image;

means to generate a two dimensional complex phase array wherein said two dimensional complex phase array is derived from a result of said means to determine said presence of said surveillance image; and means to build a precision fires image template using a result of a three dimensional to two dimensional correlation wherein said three dimensional to two dimensional correlation uses as an input said rotated three dimensional geolocated template and said two dimensional complex phase array.

9. The hand held apparatus of claim 7, said precision fires image is further comprising information from a Digital Precision Point Data Base and said two dimensional template wherein said two dimensional template contains information from said surveillance image.

10. The hand held apparatus of claim 7, said precision fires image is further comprising information from a Digital Precision Point Data Base and said two dimensional template wherein said two dimensional template contains information from said Digital Precision Point Data Base.

11. The hand held apparatus of claim 7, said precision fires image is further comprising a three dimensional grayscale topographical image having superimposed thereon, a plurality of two dimensional points appearing as dots.

12. A precision fires image computer program product in a non-transitory computer readable medium having computer program code recorded thereon, wherein the program code includes sets of instructions comprising:

first computer instructions for downloading a digital point positioning database wherein said digital point positioning database contains a plurality of stereo referenced images and an index to selectively extract a single stereo reference image from said plurality of stereo referenced images;

second computer instructions for applying a Sobel algorithm to a left half of said single stereo reference image wherein a result of applying said Sobel algorithm is a left edge pixel template;

third computer instructions for applying said Sobel algorithm to a right half of said single stereo reference image wherein a result of applying said Sobel algorithm is a right edge pixel template;

fourth computer instructions for creating a left two dimensional complex phase array corresponding to said left edge pixel template;

fifth computer instructions for creating a right two dimensional complex phase array corresponding to a said right edge pixel template;

sixth computer instructions for an edge process wherein said edge process is applied to said left two dimensional complex phase array and to said right two dimensional complex phase array, said edge process producing an edge processed image template;

seventh computer instructions for performing a correlation computation to compute a correlation between a pixel in said left two dimensional complex phase array image and a pixel in said right two dimensional complex phase array wherein a result of said correlation computation is stored in a correlation table;

eighth computer instructions for performing an offset computation and storing a result of said offset computation in an offset table wherein said result of said offset computation represents a spatial difference in location between said pixel in said left two dimensional complex phase array and said pixel in said right two dimensional complex phase array;

ninth computer instructions for performing a pixel matching comparison and storing a result of said pixel matching comparison in a workspace array wherein said pixel matching comparison compares a pixel within said edge processed image template to said pixel within said correlation table;

tenth computer instructions for performing a rational polynomial coefficient computation corresponding to said result of said correlation computation wherein a result of said rational polynomial coefficient computation is stored as a coefficient data set;

eleventh computer instructions for producing a three dimensional geolocated template using said result of said pixel matching comparison as stored in said workspace array and using said coefficient data set;

twelfth computer instructions for transforming said three dimensional geolocated template wherein a result of a transformation of said three dimensional geolocated template is a rotated three dimensional geolocated template;

thirteenth computer instructions for downloading a plurality of surveillance images;

fourteenth computer instructions for selecting a single surveillance image from said plurality of surveillance images wherein said single surveillance image has a left half and a right half;

fifteenth computer instructions for determining a presence of said single surveillance image;

sixteenth computer instructions for performing an edge process on a result of said fifteenth computer instructions;

seventeenth computer instructions for generating an additional two dimensional complex phase array wherein said additional two dimensional complex phase array is derived from a result of said presence of said single surveillance image;

eighteenth computer instructions for building a precision fires image template using a result of a three dimensional to two dimensional correlation wherein said three dimensional to two dimensional correlation correlates said rotated three dimensional geolocated template to said additional two dimensional complex phase array;

nineteenth computer instructions for synchronizing said precision fires image template and said control field to said hand held device wherein said synchronizing results in displaying said precision fires image template as a precision fires image and said control field on said hand held device;

twentieth computer instructions for accepting a first click on said precision fires image wherein said first click selects a point within said precision fires image and denotes said point with a cursor drawn onto said precision fires image;

twenty-first computer instructions for accepting a second click wherein said second click is within said control field and commands a conversion of said point to a weapons grade coordinate; and twenty-second instructions for accepting a third click wherein said third click is within said control field and commands a communication of a result of said conversion using a wireless link.

13. The precision fires image computer program product of claim 12, said conversion of said twenty-first computer instructions is further comprising:

first computer instructions for determining a two dimensional reference point from within said precision fires image template wherein said two dimensional reference point is closest to said first click;

second computer instructions for determining a set of four three dimensional points from within said precision fires image template wherein said set of four three dimensional points are determined to be closest in linear distance to said two dimensional reference point;

third computer instructions for performing a bilinear interpolation of a result of said of four closest three dimensional points wherein a result of said bilinear interpolation is a single coordinate having a latitude, a longitude, an elevation, and a set of coordinate interpolation weighting values corresponding to said two dimensional reference point;

fourth computer instructions for determining error terms for said single coordinate wherein said error terms include a circular error of probability and a linear error of probability; and fifth computer instructions for combining said single coordinate with said error terms wherein a result of combining said single coordinate with said error terms is said weapons grade coordinate.

14. The precision fires image computer program product of claim 12, said additional two dimensional complex phase array of said seventeenth computer instructions further comprising information from said surveillance image.

15. The precision fires image computer program product of claim 12, said additional two dimensional complex phase array of said seventeenth computer instructions further comprising information from said Digital Precision Point Data Base.

16. The precision fires image computer program product of claim 12, said precision fires image further comprising computer instructions for superimposing a plurality of two dimensional points appearing as dots over a three dimensional gray-scale topographical image.

17. The precision fires image computer program product of claim 12, said plurality of precision fires image further comprising computer instructions to repeat said second through said eighteenth set of computer instructions for each surveillance image downloaded.

* * * * *